US011098525B2

(12) United States Patent
Willert et al.

(10) Patent No.: US 11,098,525 B2
(45) Date of Patent: Aug. 24, 2021

(54) PROFILED ARRANGEMENT, PARTICULARLY FOR A REFRIGERATOR AND/OR FREEZER DEVICE

(71) Applicant: Rehau AG + Co., Rehau (DE)

(72) Inventors: Manfred Willert, Pegnitz (DE); Matthias Brettmann, Hof (DE)

(73) Assignee: REHAU AG + CO., Rehau (DE)

( * ) Notice: Subject to any disclaimer, the term of this patent is extended or adjusted under 35 U.S.C. 154(b) by 125 days.

(21) Appl. No.: 16/065,215

(22) PCT Filed: Dec. 22, 2016

(86) PCT No.: PCT/EP2016/002169

§ 371 (c)(1),
(2) Date: Jun. 22, 2018

(87) PCT Pub. No.: WO2017/108190

PCT Pub. Date: Jun. 29, 2017

(65) Prior Publication Data

US 2018/0372396 A1 Dec. 27, 2018

(30) Foreign Application Priority Data

Dec. 23, 2015 (DE) ..... 202015107063.2

(51) Int. Cl.
*E06B 7/23* (2006.01)
*F25D 23/08* (2006.01)

(52) U.S. Cl.
CPC ..... *E06B 7/2309* (2013.01); *E06B 7/2305* (2013.01); *E06B 7/2307* (2013.01); *F25D 23/087* (2013.01)

(58) Field of Classification Search
CPC .... F25D 23/087; E06B 7/2305; E06B 7/2307; E06B 7/2309

(Continued)

(56) References Cited

U.S. PATENT DOCUMENTS 2,908,949 A * 10/1959 Frehse ..... F25D 23/087 49/496.1
4,617,759 A * 10/1986 Pasqualini ..... F25D 23/082 312/405

(Continued)

FOREIGN PATENT DOCUMENTS

DE 60115098 8/2006
DE 102012201610 A1 * 8/2013 ..... F25D 23/087

(Continued)

OTHER PUBLICATIONS

English Abstract of EP0599161.

(Continued)

*Primary Examiner* — Marcus Menezes

(57) ABSTRACT

The invention relates to a profiled arrangement (1) particularly for a refrigerator and/or freezer device (10), comprising at least one base (8), at least one securing arrangement (2), at least one sealing arrangement (3) and at least one profiled element (5), characterised in that at least one free end (51) of the profiled element (5) is arranged on the sealing arrangement (3), and that at least one additional free end (52) of the profiled element (5) is connected to the base (8) by means of at least one movement arrangement (4) that at least partially projects into the sealing arrangement (3), said movement arrangement comprising two movement sections (40, 41) arranged approximately opposite one another. The invention also relates to a closing element (20) for a refrigerator and/or freezer device (10) having such a profiled arrangement (1), and to a refrigerator and/or freezer device (10) comprising such a profiled arrangement (1).

10 Claims, 7 Drawing Sheets

(58) Field of Classification Search
USPC ..... 49/489.1
See application file for complete search history.

(56) References Cited

U.S. PATENT DOCUMENTS

| | | | | | |
|---|---|---|---|---|---|
| 5,916,076 | A * | 6/1999 | Cittadini | F25D 23/087 | 49/475.1 |
| 6,058,657 | A * | 5/2000 | Meria | F25D 23/087 | 49/478.1 |
| 6,148,563 | A * | 11/2000 | Roche | A47F 3/0434 | 49/501 |
| 6,195,942 | B1 * | 3/2001 | Sasaki | E06B 7/2305 | 49/478.1 |
| 6,227,634 | B1 * | 5/2001 | Cittadini | F25D 23/087 | 277/630 |
| 8,490,333 | B2 * | 7/2013 | Gholap | F25D 23/087 | 49/478.1 |
| 9,841,223 | B2 * | 12/2017 | Gu | F25D 23/028 | |
| 10,174,994 | B2 * | 1/2019 | Kim | F25D 23/025 | |
| 2004/0189165 | A1 * | 9/2004 | An | E05C 19/161 | 312/405 |
| 2004/0244297 | A1 * | 12/2004 | Schuster | F16J 15/027 | 49/478.1 |
| 2008/0276540 | A1 * | 11/2008 | Kim | F25D 23/087 | 49/478.1 |
| 2009/0277096 | A1 * | 11/2009 | Ramos | F25D 23/087 | 49/478.1 |
| 2009/0314028 | A1 * | 12/2009 | Laible | E05C 19/161 | 62/449 |
| 2011/0220663 | A1 * | 9/2011 | Guba | F25D 17/047 | 220/592.02 |
| 2014/0132143 | A1 * | 5/2014 | Kim | F25D 23/028 | 312/405 |

FOREIGN PATENT DOCUMENTS

| | | | | |
|---|---|---|---|---|
| EP | 0319087 | | 6/1989 | |
| EP | 0599161 | | 6/1994 | |
| EP | 3569757 | A1 * | 11/2019 | F24C 15/021 |
| FR | 1206932 | A * | 2/1960 | F25D 23/087 |
| JP | H05118741 | | 5/1993 | |
| WO | 2003052334 | | 6/2003 | |
| WO | 2014086071 | | 6/2014 | |

OTHER PUBLICATIONS

English Abstract of DE60115098.
English Abstract of JPH05118741.
International Search Report dated Jul. 3, 2017.
Translation of International Search Report dated Jul. 3, 2017.
Written Opinion of International Searching Authority dated Mar. 7, 2017.
Translation of Written Opinion of International Searching Authority dated Mar. 7, 2017.
International Preliminary Report on Patentability dated Jun. 26, 2018.
Translation of International Preliminary Report on Patentability dated Jun. 26, 2018.

* cited by examiner

PROFILED ARRANGEMENT, PARTICULARLY FOR A REFRIGERATOR AND/OR FREEZER DEVICE

CROSS-REFERENCE TO RELATED APPLICATION

The instant application is a national phase of PCT International Application No. PCT/EP2016/002169 filed Dec. 22, 2016, and claims priority to German Patent Application Serial No. 202015107063.2 filed Dec. 23, 2015, the entire specifications of both of which are expressly incorporated herein by reference.

The invention relates to a profiled arrangement, particularly for a refrigerator and/or freezer apparatus, comprising at least one base, at least one fastening arrangement, at least one sealing arrangement, and at least one profiled element; to a closure element, and to a refrigerator and/or freezer apparatus having such a profiled arrangement.

Profiled arrangements of this type have already been described in the prior art. These profiled arrangements, particularly in the use in refrigerator and/or freezer apparatuses, have the important function of sealing the construction-related gap between the closure element and a cabinet body, of compensating tolerances, and in the case of magnetic profiled arrangements being used, of guaranteeing the closing of the refrigerator apparatus door on the cabinet body by means of a magnetic force. In the case of the profiled arrangements according to the prior art, the compensation of tolerances and the stroke of the profiled arrangement are performed by means of various bellows constructions which can be clearly seen in the visual region of said profiled arrangements.

EP 0 599 161 B1 thus discloses a profiled arrangement of the generic type.

The profiled arrangement herein is configured as a sealing arrangement for the door of a refrigerator or freezer apparatus, having a thermally insulating housing, the opening of the latter being closable by way of a door which on that side thereof that faces the opening and is equipped with an interior cladding has a bellows-type magnetic seal that is disposed in an encircling manner on the periphery of the door, said magnetic seal being equipped with a seal head and a seal foot which are interconnected by flexible walls that are configured as expansion folds, wherein the seal foot is anchored in a receptacle groove on the interior cladding, said receptacle groove tapering toward the door opening, while the seal head that is equipped with magnetic strips in the closed state of the door bears on the opening periphery of the housing and holds the door on the opening periphery, wherein the seal head is disposed so as to be laterally offset in relation to the seal foot, the latter being equipped with a unilateral convexity which interacts with an undercut in the receptacle groove and which is disposed in a manner opposed to the lateral offset so as to be closer to the seal head, wherein the side of the seal foot that is opposite the convexity is supported in the receptacle groove, wherein the seal foot is provided with an introduction wedge and on that side of the seal foot that is opposite the convexity has a protrusion which is disposed so as to be substantially level in height with the maximum of the convexity, and said introduction wedge in the receptacle groove being supported in a slightly pretensioned manner on the wall portion of the receptacle groove. The walls that are configured as expansion folds herein are disposed so as to be spaced apart from the hollow chamber of the seal head that receive the magnetic strip.

A further profiled arrangement of the generic type is disclosed in DE 601 15 098 T2. This profiled arrangement of the generic type is configured as an improved sealing arrangement for refrigerators and the like, having a profile that is produced from a plastics material, wherein the arrangement is composed of a cabinet, of a door, and of an inner door area element which can be coupled to the cabinet, and of a portion of a bellows seal which provides a sealed closure between the door and the cabinet, wherein it is provided that a profile and the sealing portion are adapted or configure a single integral part which is produced by co-extruding two materials which have dissimilar degrees of strength, so as to enable the sealing portion to be readily released from the profile along the connection between said sealing portion and the profile if necessary, wherein the profile has a flute which is equipped for receiving a replacement portion of a bellows seal, and at least one elastically resilient lateral portion which acts for providing a snapfit connection between the profile and the inner door area element, wherein the portion terminates by way of a fluted receptacle which has a substantially C-shaped cross section and is designed so as to receive an edge of the inner door area element, wherein it is furthermore envisaged that the profile has a base which at opposite ends is provided with sealing strips which interact with the door and the inner door area element, wherein at least one sealing strip which is produced from a soft material and is installed opposite the edge of the inner door area element is provided on the fluted receptacle such that the sealing strip, when the inner door area element is effectively coupled to the profile, under the effect of an elastic restoration of the portion is compressed against the edge of the inner door area element, wherein it is furthermore envisaged that a curvature region in the right angle of the inner door area element has a radius of approximately 3 to 6 mm so as to ensure an optimal contrasting effect with one of the sealing strips of the base of the profile.

The sealing portion is furthermore configured such that the former establishes an expandable chamber which acts as a bellows and has an upper chamber which is designed so as to receive a rod made from a magnetic material. A gap is configured between the upper chamber, or the expandable chamber, respectively, and the sealing arrangement.

It is disadvantageous in the case of this prior art that contamination settles very easily in the region of the expansion folds in the various geometries of the bellows seals, or the sealing arrangements, respectively, said contamination being removable only with great difficulty.

A further disadvantage of the profiled arrangements from the prior art lies in that the visual impact that faces the observer in particular in the case of closed refrigerator and/or freezer apparatuses in the gap between the door and the cabinet body of the refrigerator and/or freezer apparatus is not visually appealing on account of this sealing arrangement.

The invention proceeds from this point, the former being based on the object of providing a profiled arrangement of the generic type which overcomes the disadvantages of the known prior art, which is producible in an economic and cost-effective manner, which in a visually appealing manner covers the construction-related gap between the closure element and the cabinet body of a refrigerator and/or freezer apparatus, which is easy to clean, and which while at the same time maintaining the required compensation of tolerances has an optimized profile stroke, and such a closure element and of providing a refrigerator and/or freezer apparatus having such a profiled arrangement.

The aforementioned is achieved according to the invention by the features of claim 1 and of claim 2, and of claims 17 and 18. Further advantageous design embodiments are described in the dependent claims.

It has been surprisingly demonstrated that a profiled arrangement, particularly for a refrigerator and/or freezer apparatus, comprising at least one base, at least one fastening arrangement, at least one sealing arrangement, and at least one profiled element, is distinguished in that at least one free end of the profiled element is disposed on the sealing arrangement, in that a further free end of the profiled element is connected to the base by way of at least one movement arrangement which at least partially protrudes into the sealing arrangement and which has two movement portions which are disposed so as to be approximately opposite one another.

It has furthermore been surprisingly demonstrated that in the case of the profiled arrangement according to the invention, particularly for a refrigerator and/or freezer apparatus, comprising at least one base, at least one fastening arrangement, at least one sealing arrangement, and at least one profiled element, is distinguished in that at least one free end of the profiled element is disposed on the sealing arrangement, in that at least a further free end of the profiled element is disposed spaced apart from the base by way of at least one movement arrangement that is at least partially disposed on the sealing arrangement.

The profiled arrangement according to the invention is configured such that the movement of the sealing arrangement that is required for the intended use by way of the movement arrangement is relocated to the region that is not visible from the outside, such that the construction-related gap between the closure element and the cabinet body of a refrigerator and/or freezer apparatus is covered in a visually appealing manner, on the one hand, and the desired functionality of the refrigerator and/or freezer apparatus continues to be provided in an optimal manner, on the other hand.

The profiled arrangement according to the invention herein is furthermore configured such that the profiled element in the intended use on a closure element and/or a refrigerator and/or freezer apparatus covers in a sealing manner the construction-related gap between the closure element and the cabinet body of the refrigerator and/or freezer apparatus.

A further advantage of the profiled arrangement according to the invention lies in that on account of the arrangement and the design embodiment of the profiled element in the gap between the closure element and the cabinet body of the refrigerator and/or freezer apparatus, said profiled arrangement is also very easy to clean, for example on account of a linear planar geometry of the profiled element.

It is furthermore advantageous in the case of the profiled arrangement according to the invention that the profiled element is disposed approximately at an acute or an obtuse angle on the sealing arrangement. Profiled arrangements according to the invention which are producible in an economical and cost-effective manner and which are readily adaptable to the dissimilarly dimensioned gaps between the closure element of a refrigerator and/or freezer apparatus can thus be provided.

It is furthermore advantageous in the case of the profiled arrangement according to the invention that the profiled element is disposed on the sealing arrangement so as to be approximately orthogonal. On account of the profiled arrangement according to the invention, it is for the first time possible in this advantageous design embodiment for the construction-related gap between the closure element and the cabinet body of a refrigerator and/or freezer apparatus to be provided across the full area, in a visually appealing manner, and while fully maintaining the functionality of the profiled arrangement according to the invention.

In the case of the profiled arrangement according to the invention it has furthermore proven advantageous wherein for the profiled element be configured so as to be approximately linear, approximately prismatic in the cross section, and to have a wall thickness of approximately 0.1 to 10 mm, preferably approximately 0.25 to 5 mm. On account thereof, the profiled arrangement according to the invention can be produced in an economical and cost-effective manner, and the profiled element of the profiled arrangement according to the invention can be adapted in an optimal manner to the various technical, geometrical and visual requirements set for the construction-related gap between a closure element and the cabinet body of a refrigerator and/or freezer apparatus.

In the case of the profiled arrangement according to the invention it has likewise proven advantageous for the profiled element between the free ends thereof to have a width of approximately 5 to 50 mm, preferably approximately 7 to 40 mm. The profiled arrangement according to the invention can thus be produced in an economical and cost-effective manner for all currently known gaps between the closure element and the cabinet body of a refrigerator and/or freezer apparatus in the known prior art.

In a further advantageous design embodiment of the profiled arrangement according to the invention the profiled element is disposed on at least one hollow chamber of the sealing arrangement. On account thereof, the profiled arrangement according to the invention can be produced in an economical and cost-effective manner in the most varied geometries, and can be adapted in respectively dissimilar gaps between the closure element and the cabinet body of a refrigerator and/or freezer apparatus.

It is likewise advantageous in the case of the profiled arrangement according to the invention that the profiled element is connected to the sealing arrangement by way of at least one reinforcement element. On account thereof, a profiled arrangement according to the invention is producible which in the intended use in a gap between the closure element and the cabinet body of a refrigerator and/or freezer apparatus, besides a visually appealing closure also ensures that a stabilization of the sealing arrangement is implementable in the intended use by opening or closing the closure element, respectively.

It is likewise advantageous in the case of the profiled arrangement according to the invention that the profiled element is connected to at least one hollow chamber of the sealing arrangement by way of at least one reinforcement element. The profiled arrangement according to the invention in this advantageous design embodiment is designed or dimensioned, respectively, such that in the intended use of said profiled arrangement the functioning of the sealing arrangement is optimized or stabilized, respectively.

In the case of the profiled arrangement according to the invention it has likewise advantageously demonstrated for the profiled element to have at least one cover element. On account of this design embodiment of the profiled arrangement according to the invention it is possible in the intended use on a closure element and/or on a cabinet body of a refrigerator and/or freezer apparatus for the tolerance differences of the latter to be able to be covered directly in a visually appealing manner.

In the case of the profiled arrangement according to the invention herein it has furthermore advantageously demonstrated for the at least one movement arrangement to protrude into the sealing arrangement approximately at an acute angle in relation to the profiled element. On account thereof, in the case of the profiled arrangement according to the invention it is surprisingly possible that the movement arrangement that is required for the functioning of the sealing arrangement in the intended use, when used on a closure element or on a cabinet body of a refrigerator and/or freezer apparatus, profiled arrangement according to the invention being disposed on the latter, is no longer visible to the user from the outside, without the functionality being compromised.

A further advantage of the profiled arrangement according to the invention lies in that the at least one movement arrangement is disposed so as to be approximately orthogonal to the base of the profiled arrangement. This advantageously leads to the profiled arrangement according to the invention, in the intended use thereof, having the required flexibility particularly of the sealing arrangement in the case of dissimilarly dimensioned gaps between the closure element and the cabinet body of a refrigerator and/or freezer apparatus.

It is likewise advantageous in the case of the profiled arrangement according to the invention that the at least one movement arrangement is connected to the profiled element by way of at least one reinforcement element. The profiled arrangement according to the invention in this design embodiment is dimensioned such that in the intended use of said profiled arrangement the functioning of the sealing arrangement is further optimized or stabilized in a reinforcing manner, respectively.

In the case of the profiled arrangement according to the invention it has furthermore advantageously demonstrated herein for the movement portions of the at least one movement arrangement to be interconnected by way of at least one connection element. On account of this advantageous design embodiment of the profiled arrangement according to the invention, the profiled arrangement according to the invention in the intended use for sealing a gap between the closure element and the cabinet body of a refrigerator and/or freezer apparatus is adaptable in an optimal manner to be tolerance-related differences in the gap dimensions.

In the case of the profiled arrangement according to the invention it is likewise advantageous for the movement portions of the at least one movement arrangement to have approximately half the wall thickness of the profiled element. On account thereof it is surprisingly possible for the profiled arrangement according to the invention, in the intended use thereof, to close the gap between a closure element and a cabinet body of a refrigerator and/or freezer apparatus in a visually appealing manner, while at the same time maintaining an optimal mobility of the sealing arrangement.

A further advantage of the profiled arrangement according to the invention lies in that the sealing arrangement and/or the movement arrangement and/or the profiled element are/is produced from a soft elastic polymer material having a Shore A hardness according to DIN EN ISO 868 of approximately 50 to 100, preferably 60 to 90. By varying the individual polymer materials of the sealing arrangement and/or of the movement arrangement and/or of the profiled element of the profiled arrangement according to the invention, all currently known dimensions of the gap between the closure element and the cabinet body of a refrigerator and/or freezer apparatus in a visually appealing manner can for the first time be implemented while fully maintaining the functionality by way of the profiled arrangement according to the invention.

The profiled arrangement according to the invention is likewise advantageously configured such that the base and/or the fastening arrangement are/is produced from a polymer material having a Shore D hardness according to DIN EN ISO 868 of approximately 60 to 90, preferably 65 to 85. The profiled arrangement according to the invention can thus be more easily assembled on and fixed to a closure element and/or a cabinet body of a refrigerator and/or freezer apparatus.

The invention furthermore relates to a closure element for a refrigerator and/or freezer apparatus having a profiled arrangement according to the explanations above.

The invention furthermore relates to a refrigerator and/or freezer apparatus having a profiled arrangement according to the explanations above.

The profiled arrangement according to the invention is now to be described by means of exemplary embodiments which do not limit the invention.

In the figures.

Figure 1:
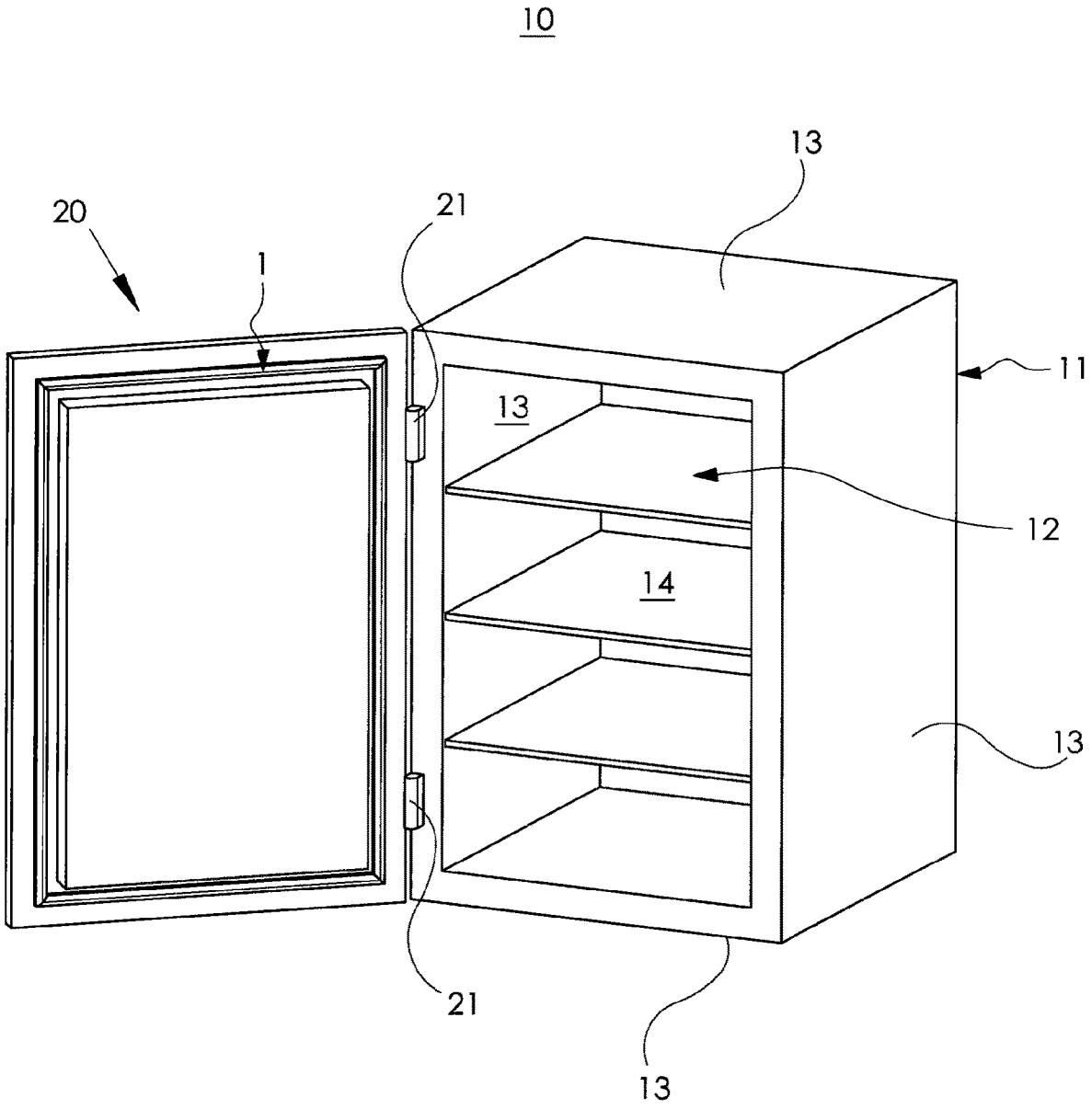
FIG. 1 shows a perspective illustration of a refrigerator and/or freezer apparatus having a closure element and a profiled arrangement according to the invention.

FIG. 1 shows a profiled arrangement 1 according to the invention on a closure element 20 of a refrigerator and/or freezer apparatus 10.

The refrigerator and/or freezer apparatus 10 has a cabinet-shaped cabinet body 11, the walls 13 thereof delimiting the interior 14 of the refrigerator and/or freezer apparatus 10.

The opening 12 on the front side of the cabinet body 11 is closable in a sealing manner by the closure element 20 and by the profiled arrangement 1 according to the invention which is disposed on said opening 20.

The closure element 20 by way of hinge arrangements 21 is disposed on the cabinet body 11 of the refrigerator and/or freezer apparatus 10 so as to be pivotable about a vertical axis in this exemplary embodiment.

The profiled arrangement 1 according to the invention in this exemplary embodiment is disposed on that side of the closure element 20 that is opposite the cabinet body 11 of the refrigerator and/or freezer apparatus 10 such that the profiled arrangement 1 in the case of a closed position of the closure element 20 bears on the cabinet body 11 about the opening 12 of the refrigerator and/or freezer apparatus 10 and seals the gap between the closure element 20 and the cabinet body 11 of the refrigerator and/or freezer apparatus 10 in a visually appealing manner.

Figure 2:
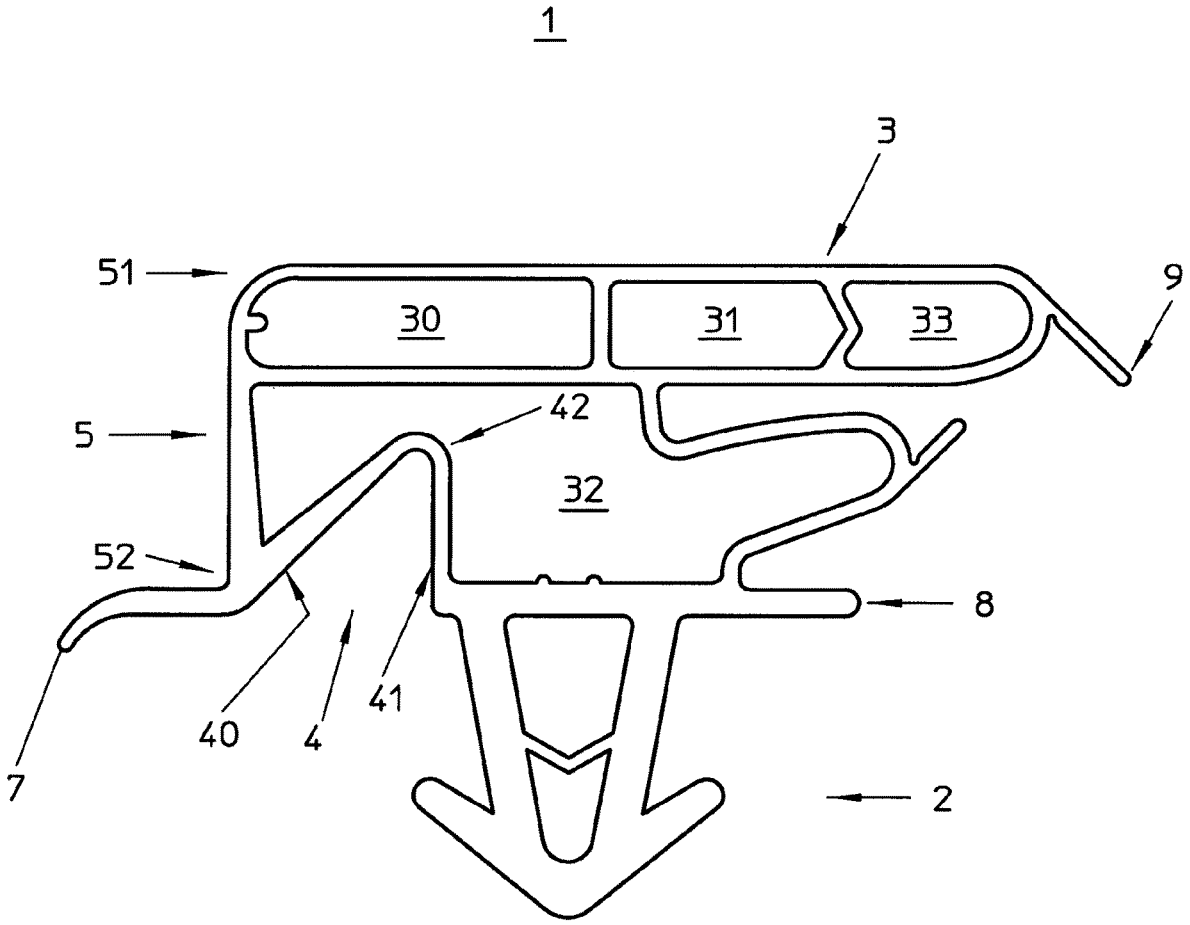
FIG. 2 shows a sectional illustration of a profiled arrangement according to the invention.

A sectional illustration of a profiled arrangement 1 according to the invention is illustrated in FIG. 2.

The profiled arrangement 1 according to the invention has a base 8, a fastening arrangement 2, a sealing arrangement 3, and at least one profiled element 5.

The free end 51 of the profiled element 5 in this exemplary embodiment is disposed on the sealing arrangement 3, wherein the free end 52 of the profiled element 5 by way of at least one is connected to the base 8 by way of at least one movement arrangement 3 which at least partially protrudes into the sealing arrangement 3 and which has at least one movement portion 40, 41. The profiled element 5 in this exemplary embodiment is disposed on the sealing arrangement 3 so as to be approximately orthogonal. The profiled element 5 is configured so as to be linear, approximately prismatic in the cross section, and in this exemplary embodiment has a mean wall thickness of approximately 1.2 mm. The profiled element 5 of the profiled arrangement 1 according to the invention is furthermore configured such that said profiled element 5 between the free ends 51, 52 thereof has a width of approximately 20 mm. The profiled element 5 of the profiled arrangement 1 according to the invention on the free end 52 thereof furthermore has at least one cover element 7 which is integrally connected to said profiled element 5.

The sealing arrangement 3 which in this exemplary embodiment has the hollow chamber 30, 31, 32, 33 is disposed on the free end 51 of the profiled element 5.

The profiled arrangement 1 according to the invention is furthermore configured such that a further seal element 9 is disposed so as to be integral to at least one hollow chamber 30, 31, 32, 33.

The free end 52 of the profiled element 5 is connected to the base 8 of the profiled arrangement 1 according to the invention by way of at least one movement arrangement 4.

The movement arrangement 4 in this exemplary embodiment is configured so as to protrude into the sealing arrangement 3 at an angle that is approximately acute in relation to the profiled element 3.

The movement arrangement 4 of the profiled arrangement 1 according to the invention in this exemplary embodiment furthermore has two movement portions 40, 41 which are disposed so as to be mutually opposite and which are interconnected by way of a connection element 42. The movement arrangement 4 of the profiled arrangement 1 according to the invention in this exemplary embodiment is configured such that the movement portion 40 has approximately the same wall thickness as the profiled element 5, while the movement portion 41 and the connection element 42 have approximately half the wall thickness of the movement portion 40.

The profiled arrangement 1 according to the invention is furthermore configured such that the base 8 by way of the movement arrangement 4 is disposed so as to be spaced apart from the profiled element 5 in an approximately orthogonal manner. The movement arrangement 4 of the profiled arrangement 1 according to the invention in this exemplary embodiment is furthermore configured such that said movement arrangement 4 is disposed so as to be approximately orthogonal to the base 8.

The movement arrangement 4 of the profiled arrangement 1 according to the invention in this exemplary embodiment has a first movement portion 40 and a second movement portion 41, disposed so as to be opposite to the first movement portion 40, said movement portions 40, 41 being interconnected in a materially integral manner by way of the connection element 42.

The first movement portion 40 of the movement arrangement 4 in this exemplary embodiment is disposed at an acute angle to the profiled element 5.

The second movement portion 41 of the movement arrangement 4 in this exemplary embodiment is disposed so as to be approximately orthogonal to the base 8 of the profiled arrangement 1 according to the invention.

The connection element 42 of the movement arrangement 4 connects the movement portions 40, 41 by way of a radius of approximately R2.

A fastening arrangement 2 is disposed on the base 8 of the profiled arrangement 1 according to the invention, said fastening arrangement 2 being disposed on the base 8 so as to be approximately orthogonal.

The profiled arrangement 1 according to the invention in this exemplary embodiment is configured such that the sealing arrangement 3, the movement arrangement 4, and the profiled element 5 are produced from a soft elastic polymer material having a Shore A hardness according to DIN EN ISO 868 of approximately 75.

The base 8 and the fastening arrangement 2 of the profiled arrangement 1 according to the invention are likewise produced from a polymer material having the Shore D hardness according to DIN EN ISO 868 of approximately 80.

Figure 3:
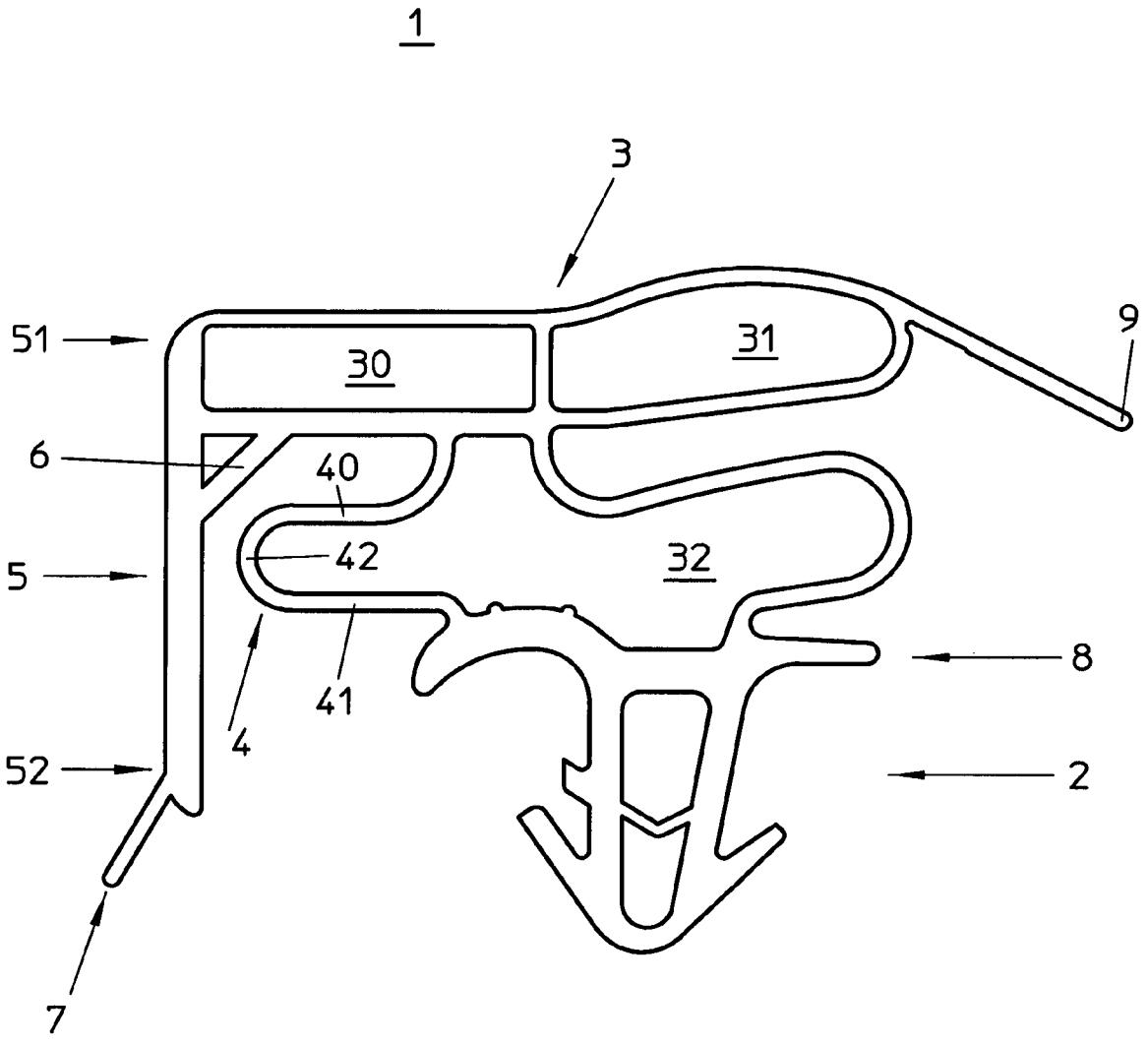
FIG. 3 shows a sectional illustration of a further profiled arrangement according to the invention.

A sectional illustration of a further profiled arrangement 1 according to the invention is illustrated in FIG. 3.

The profiled arrangement 1 according to the invention has a base 8, a fastening arrangement 2, at least one sealing arrangement 3, and at least one profiled element 5.

The free end 51 of the profiled element 5 is disposed on the sealing arrangement 3, wherein the free end 52 of the profiled element 5 by way of at least one movement arrangement 4 which at least partially protrudes into the sealing arrangement 3 is disposed so as to be spaced apart from the base 8.

The profiled element 5 in this exemplary embodiment is disposed on the sealing arrangement 3 approximately at a right angle. The profiled element 5 is configured so as to be approximately linear, approximately rectangular in the cross section, and in this exemplary embodiment has a wall thickness of approximately 2 mm.

The free end 51 of the profiled element 5 in this exemplary embodiment is disposed on the hollow chamber 30 of the sealing arrangement 3.

The profiled element 5 in this exemplary embodiment between the free ends 51, 52 thereof has a width of approximately 16 mm.

The profiled element 5 of the profiled arrangement 1 according to the invention in this exemplary embodiment is connected to the sealing arrangement 3 by way of a reinforcement element 6. The reinforcement element 6 herein is configured such that said reinforcement element 6 is disposed respectively on the profiled element 5 and on the hollow chamber 30 of the sealing arrangement 3 at an angle of approximately 45°.

A further hollow chamber 31, 32 is disposed so as to be in each case adjacent to the hollow chamber 30 of the sealing arrangement 3.

The profiled arrangement 1 according to the invention in this exemplary embodiment is configured such that at least one movement arrangement 4 protrudes into the sealing arrangement 3 at an approximately right angle in relation to the profiled element 5.

The movement arrangement 4 according to the invention in this exemplary embodiment is disposed so as to be spaced apart from the profiled element 5 and so as not to be connected to the latter.

The movement arrangement 4 of the profiled arrangement 1 in this exemplary embodiment furthermore has two movement portions 40, 41 which are disposed so as to be mutually opposite and which are interconnected by way of at least one connection element 42.

The first movement portion 40 of the movement arrangement 4 in this exemplary embodiment is configured such that said first movement portion 40 is configured so as to be approximately S-shaped in the cross section and so as to be in each case spaced apart from the profiled element 5 and from the reinforcement element 6. The first movement portion 40 of the movement arrangement 4 is furthermore configured such that said first movement portion 40 is disposed on the hollow chamber 30 of the sealing arrangement 3.

It is also within the scope of the invention that the first fastening portion 40 of the movement arrangement 4 is disposed on the reinforcement element 6 and/or on the hollow chamber 31, 32 of the sealing arrangement 3.

The profiled arrangement 1 according to the invention in this exemplary embodiment is configured such that the sealing arrangement 3 and the movement arrangement 4 are produced from a soft elastic polymer material which in this exemplary embodiment is a polyvinyl chloride (PVC) having a Shore A hardness according to DIN EN ISO 868 of approximately 77.

The base 8, the fastening arrangement 2, and the profiled element 5 of the profiled arrangement 1 according to the invention in this exemplary embodiment are likewise produced from a polymer material, specifically polyvinyl chloride (PVC), having a Shore D hardness according to DIN EN ISO 868 of approximately 80.

Figure 4:
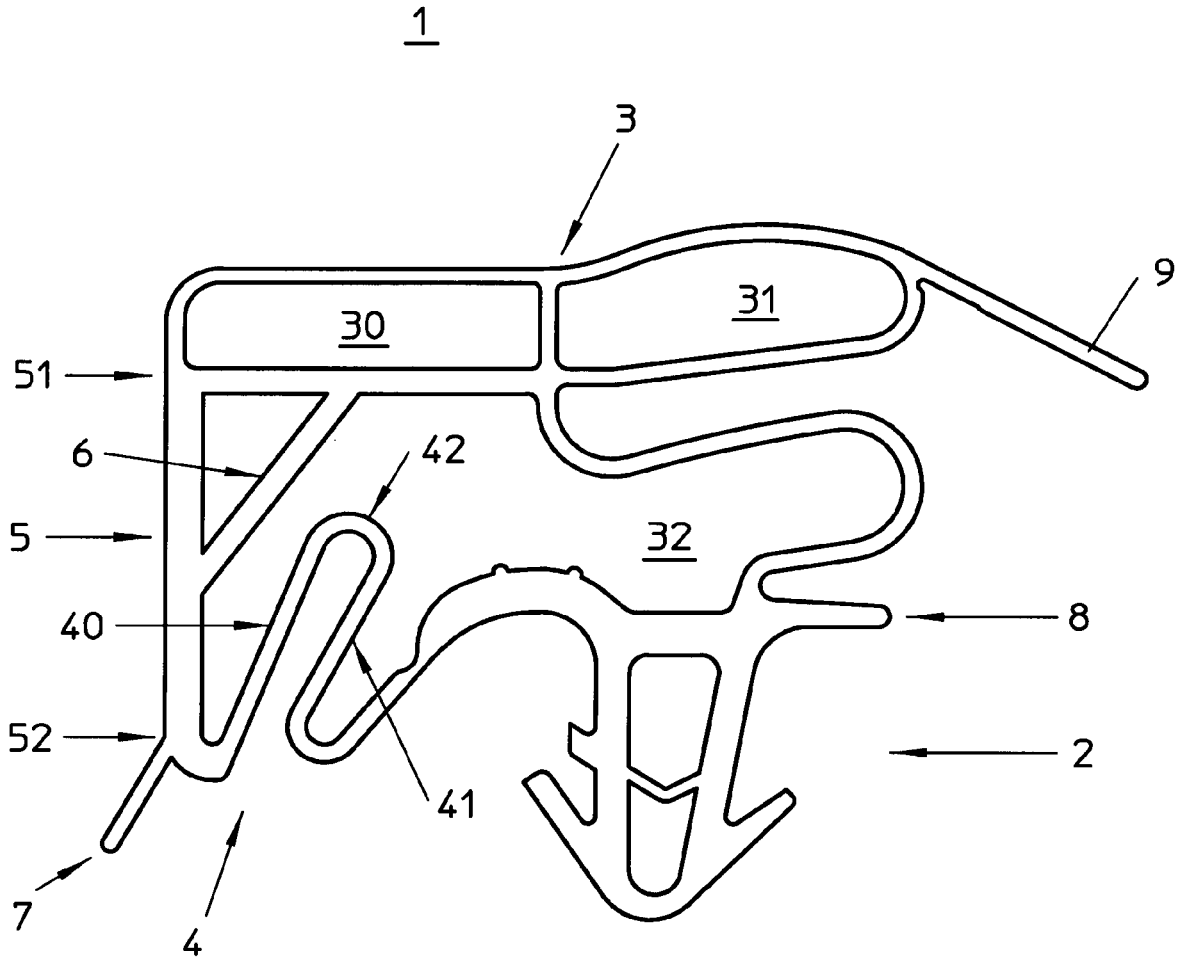
FIG. 4 shows a sectional illustration of a further profiled arrangement according to the invention.

A sectional illustration of a further profiled arrangement 1 according to the invention is illustrated in FIG. 4.

The profiled arrangement 1 according to the invention comprises a base 8, a fastening arrangement 2, at least one sealing arrangement 3, and a profiled element 5.

The free end 51 of the profiled element 5 is disposed on the sealing arrangement 3, wherein the free end 52 of the profiled element 5 by way of at least one is connected to the base 8 by way of at least one movement arrangement 4 which at least partially protrudes into the sealing arrangement 3.

The profiled arrangement 1 according to the invention is furthermore configured such that the free end 52 of the profiled element 5 by way of a movement arrangement 4 which at least partially protrudes into the sealing arrangement 3 is disposed so as to be spaced apart from the base 8. The profiled element 5 of the profiled arrangement 1 according to the invention is furthermore configured such that said profiled element 5 on the free end 52 thereof has a cover element 7 which is disposed in a materially integral manner.

The profiled element 5 in relation to the hollow chamber 30 of the sealing arrangement 3 is disposed on said hollow chamber 30 so as to be approximately orthogonal. The profiled element 5 is configured so as to be approximately linear, prismatic in the cross section, and has a wall thickness of approximately 1.1 mm.

The profiled arrangement 1 according to the invention is furthermore configured such that the profiled element 5 is connected to the sealing arrangement 3 by way of a reinforcement element 6.

The profiled element 5 in this exemplary embodiment is connected to the hollow chamber 30 of the sealing arrangement 3 by way of a reinforcement element 6.

The movement arrangement 4 of the profiled arrangement 1 according to the invention in this exemplary embodiment is configured so as to protrude into the sealing arrangement 3 at an angle that is approximately acute in relation to the profiled element 5.

The movement arrangement 4 in this exemplary embodiment has two movement portions 40, 41 which are disposed so as to be mutually opposite and which are interconnected by way of at least one connection element 42.

The first movement portion 40 in this exemplary embodiment is configured so as to be approximately parallel to the second movement portion 41 of the movement arrangement 4.

The connection element 42 connects the first movement portion 40 to the second movement portion 41 of the movement arrangement 4 by way of a radius of approximately R 1.2.

The profiled arrangement 1 according to the invention is furthermore configured such that the base 8 is disposed so as to be approximately orthogonal to the profiled element 5, and that the fastening arrangement 2 is disposed in a materially integral manner at an approximately right angle on the base 8.

The profiled arrangement 1 according to the invention is furthermore configured such that the sealing arrangement 3 has a further seal element 9 which in this exemplary embodiment is disposed in a materially integral manner on the hollow chamber 31.

Figure 5:
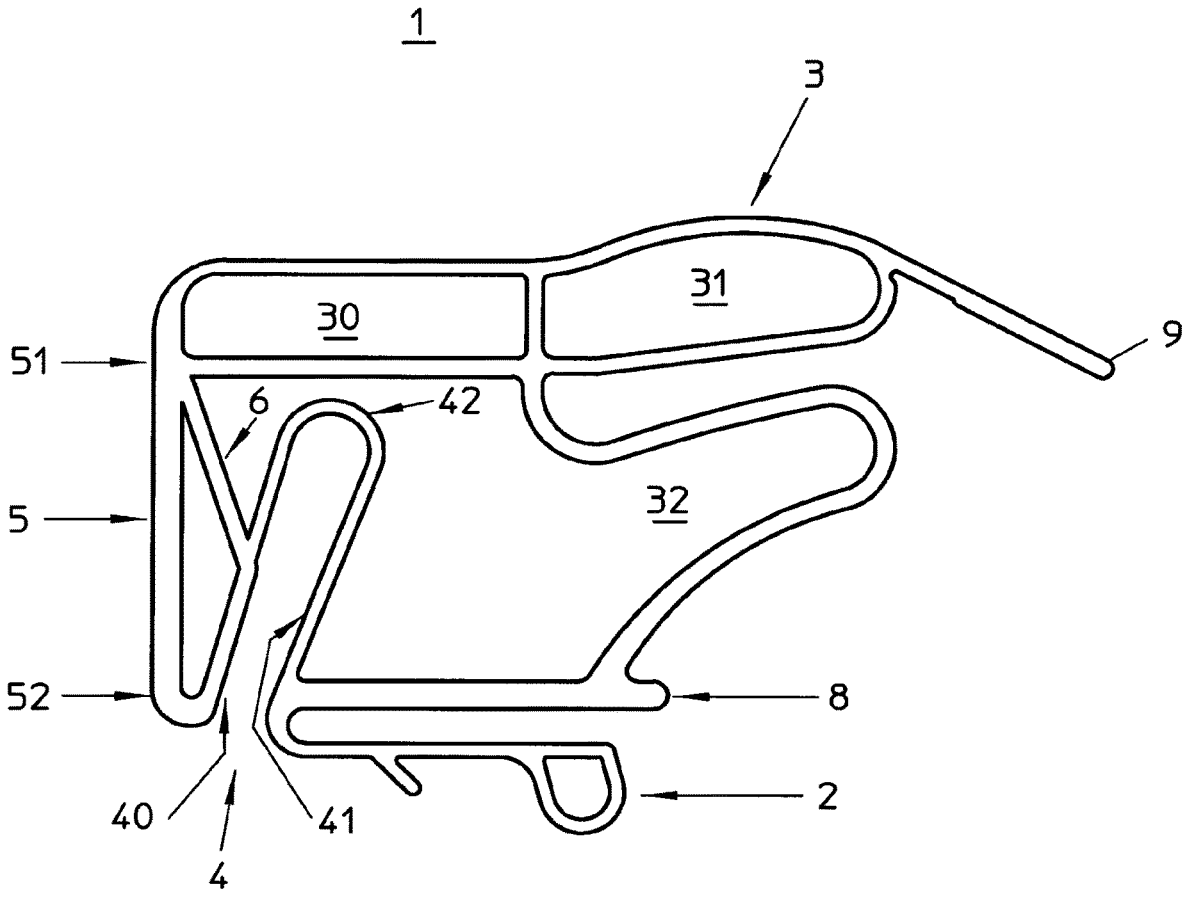
FIG. 5 shows a sectional illustration of a further profiled arrangement according to the invention.

A sectional illustration of a further profiled arrangement 1 according to the invention is illustrated in FIG. 5.

The profiled arrangement 1 according to the invention is configured such that said profiled arrangement 1 has a base 8, a fastening arrangement 2, a sealing arrangement 3, and at least one profiled element 5.

The fastening arrangement 2 is configured such that said fastening arrangement 2 in the intended use is fixed to a closure element 20 and/or to a cabinet body 11 of a refrigerator and/or freezer apparatus 10 in that the components of the closure element 20 and/or of the cabinet body 11 of a refrigerator and/or freezer apparatus 10 are fixedly connected to the fastening arrangement 2, or are fixed to the latter in a materially integral manner, respectively The fastening arrangement 2 in this exemplary embodiment is configured such that said fastening arrangement 2 is disposable on a closure element 20 (not illustrated here) and/or on a cabinet body 11 (not illustrated here) of a refrigerator and/or freezer apparatus 10 such that the closure element 20, or the cabinet body 11, respectively, is capable of being foam-filled by way of a foam material such that without which the profiled arrangement 1 is compromised on account thereof. However, it is also within the scope of the invention that the fastening arrangement 2 is configured such that said fastening arrangement 2 is fixable to the respective closure element 20 and/or to a cabinet body 11 of a refrigerator and/or freezer apparatus 10 by way of adhesives and/or adhesive tapes known per se.

The free end 51 of the profiled element 5 is disposed on the sealing arrangement 3, while the further free end 52 of the profiled element 5 by way of at least one is connected to the base 8 by way of at least one movement arrangement 4 which at least partially protrudes into the sealing arrangement 3 and which has at least one movement portion 40, 41.

The profiled element 5 of the profiled arrangement 1 according to the invention in this exemplary embodiment is disposed on the sealing arrangement 3 so as to be approximately orthogonal. The hollow chamber 30 of the sealing arrangement 3 in this exemplary embodiment is disposed on the free end 51 of the profiled element 5.

The profiled element 5 is configured so as to be approximately linear, approximately rectangular in the cross section, and has a wall thickness of approximately 2.5 mm. The profiled element between the free ends 51, 52 thereof furthermore has a width of approximately 17 mm.

The sealing arrangement 3 in this exemplary embodiment is configured such that said sealing arrangement 3 has hollow chambers 30, 31, 32 which bear on one another, wherein the hollow chamber 31 is disposed so as to be spaced apart from the hollow chamber 32 of the sealing arrangement 3.

The profiled arrangement 1 according to the invention is furthermore configured such that the movement arrangement 4 is configured so as to protrude into the sealing arrangement 3 approximately at an acute angle in relation to the profiled element 5.

The movement arrangement 4 of the profiled arrangement 1 according to the invention in this exemplary embodiment is configured such that said movement arrangement 4 is connected to the profiled element 5 by way of a reinforcement element 6.

The movement arrangement 4 of the profiled arrangement 5 according to the invention in this exemplary embodiment has two movement portions 40, 41 which are disposed so as to be mutually opposite. The movement arrangement 4 of the profiled arrangement 1 according to the invention is furthermore configured such that the movement portions 40, 41 are interconnected by way of a connection element 42.

The movement arrangement 4 having the reinforcement element 6 connecting the profiled element 5 in this exemplary embodiment the is disposed on the first movement portion 40 of the movement arrangement 4.

The profiled arrangement 1 according to the invention furthermore has a base 8 and a fastening element 2 that is disposed on the latter, said base 8 being produced from the polymer material polypropylene (PP) having a Shore D hardness according to DIN EN ISO 868 of approximately 73.

The sealing arrangement 3, the movement arrangement 4, and the profiled element 5 in this exemplary embodiment are produced from the olefin-based soft elastic polymer material thermoplastic elastomer, having a Shore A hardness according to DIN EN ISO 868 of approximately 75.

Figure 6:
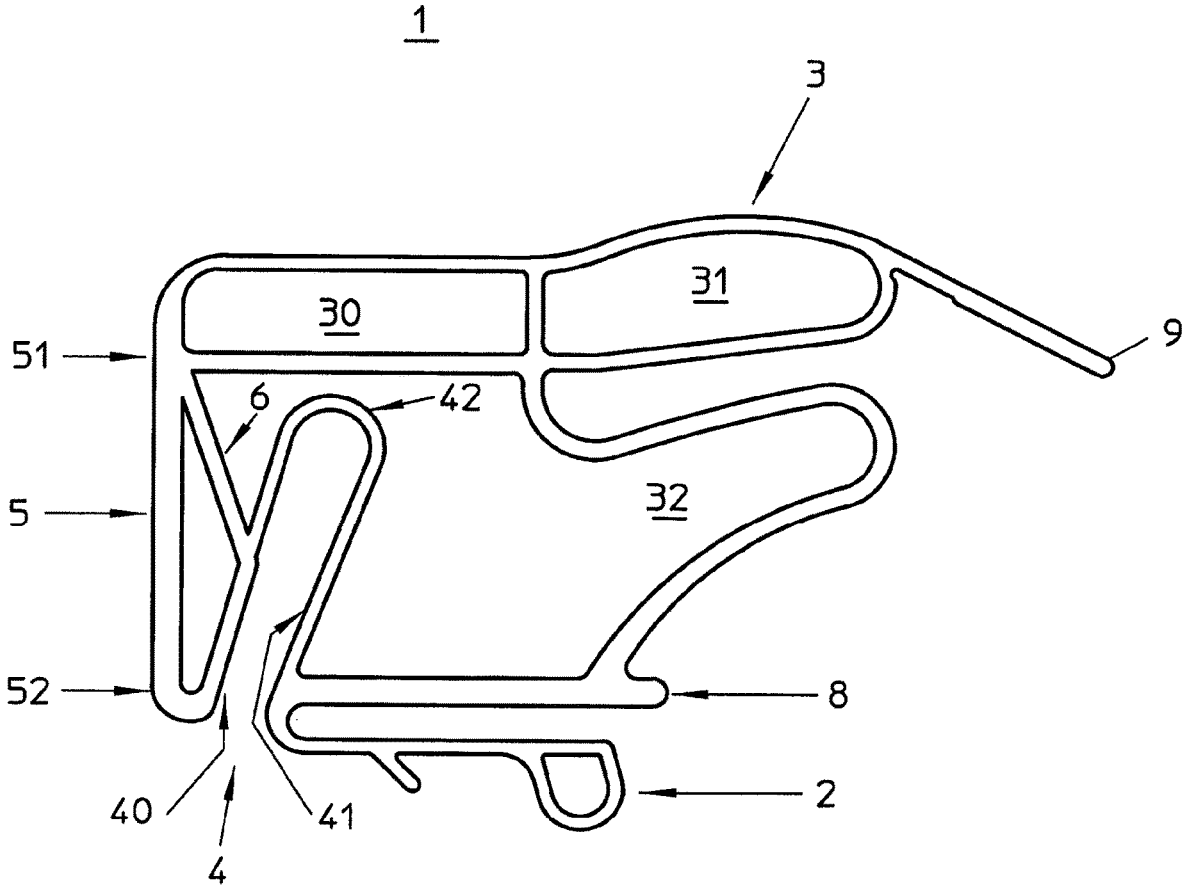
FIG. 6 shows a sectional illustration of a further profiled arrangement according to the invention.

A sectional illustration of a further profiled arrangement 1 according to the invention is illustrated in FIG. 6.

The profiled arrangement 1 according to the invention comprises a base 8, at least one fastening arrangement 2, at least one sealing arrangement 3, and at least one profiled element 5.

The profiled arrangement 1 in this exemplary embodiment is configured such that said profiled arrangement 1 has two profiled elements 5 which are disposed so as to be mutually opposite.

The free end 51 of the profiled element 5 is disposed on the sealing arrangement 3, while the further free end 52 of the profiled element 5 by way of at least one is connected to the base 8 by way of at least one movement arrangement 4 which at least partially protrudes into the sealing arrangement 3 and which has at least one movement portion 40, 41.

The profiled arrangement 1 in this exemplary embodiment is configured such that in each case two movement arrangements 4 which are disposed so as to be mutually opposite are disposed on the base 8, said two movement arrangements 4 protruding into the sealing arrangement 3 in an approximately orthogonal manner.

The profiled element 5 is configured so as to be approximately linear, somewhat prismatic in the cross section, and has a wall thickness of approximately 1.8 mm. The profiled element 5 in this exemplary embodiment between the free ends 51, 52 thereof has a width of approximately 30 mm.

The profiled element 5 of the profiled arrangement 1 according to the invention is furthermore configured such that said profiled element 5 closes the hollow chamber 30 and the hollow chamber 32 of the sealing arrangement 3.

The profiled element 5 of the profiled arrangement 1 according to the invention is furthermore configured such that said profiled element 5 is connected to the hollow chamber 30 as well as to the hollow chamber 31 of the sealing arrangement 3 by way of a reinforcement element 6.

In each case a cover element 7 that is disposed at an acute angle is disposed on the free end 52 of the profiled element 5.

The movement arrangement 4 of the profiled arrangement 1 according to the invention in this exemplary embodiment is disposed directly on the base 8 and so as to be spaced apart from the free end 52 of the profiled element 5 by way of a web 43.

The movement arrangement 4 has two movement portions 40, 41 which are disposed so as to be mutually opposite and which are interconnected by way of a connection element 42.

The movement arrangement 4 in this exemplary embodiment is configured so as to protrude into the sealing arrangement 3 in an orthogonal manner to the base 8 as well as in an orthogonal manner to the profiled element 5. The fastening arrangement 2 is disposed on the base 8.

The profiled arrangement 5 in this exemplary embodiment is produced from the olefin-based soft elastic polymer material thermoplastic elastomer, having a Shore A hardness according to DIN ISO 868 of approximately 78.

Figure 7:
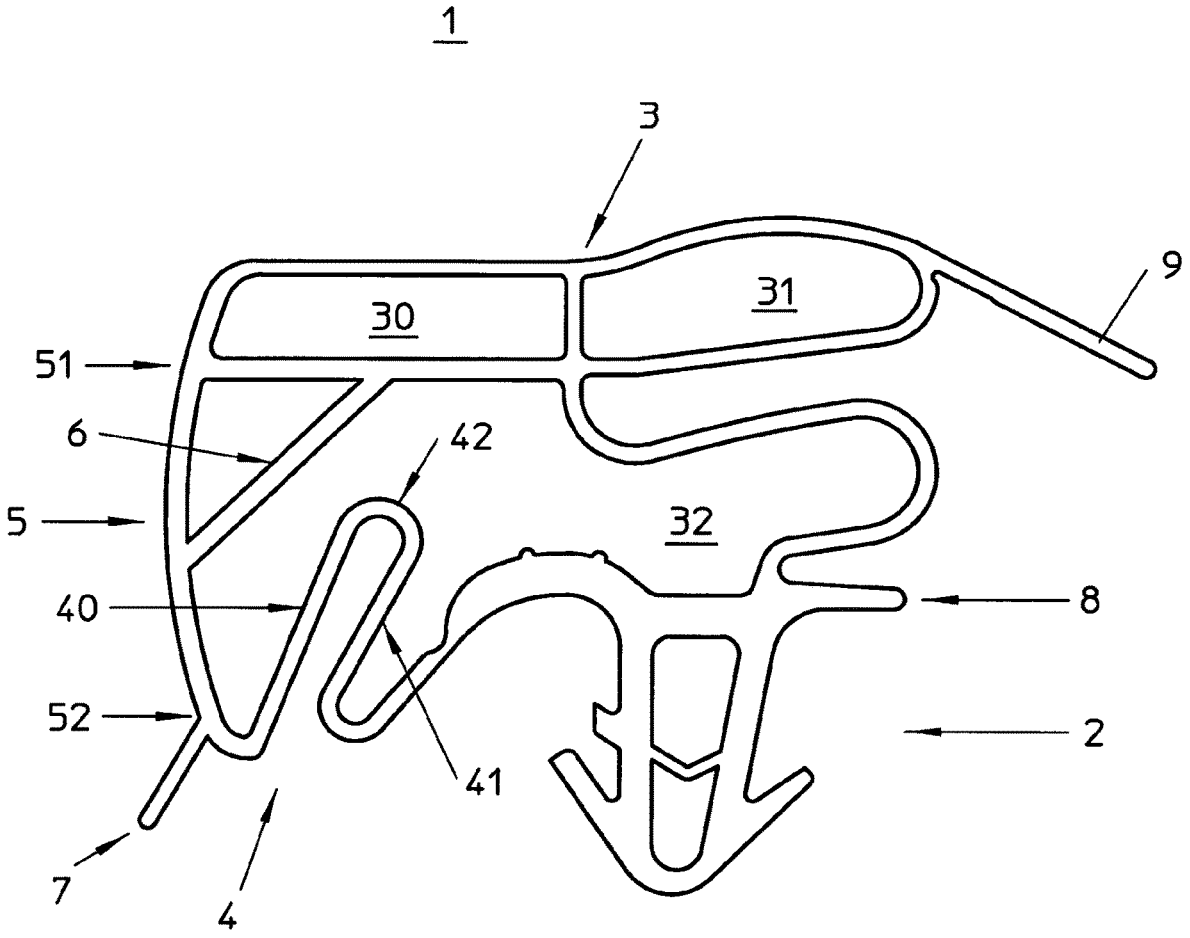
FIG. 7 shows a sectional illustration of a further profiled arrangement according to the invention.

A sectional illustration of a further profiled arrangement 1 according to the invention is illustrated in FIG. 7.

The profiled arrangement 1 according to the invention comprises a base 8, a fastening arrangement 2, at least one sealing arrangement 3, and a profiled element 5.

The free end 51 of the profiled element 5 is disposed on the sealing arrangement 3, wherein the free end 52 of the profiled element 5 is connected to the base 8 by way of at least one movement arrangement 4 which at least partially protrudes into the sealing arrangement 3.

The profiled arrangement 1 according to the invention is furthermore configured such that the free end 52 of the profiled element 5 by way of a movement arrangement 4 which at least partially protrudes into the sealing arrangement 3 is disposed so as to be spaced apart from the base 8. The profiled element 5 in relation to the hollow chamber 30 of the sealing arrangement 3 is disposed directly thereon.

The profiled element 5 is furthermore configured such that said profiled elements in the cross section has a convex contour having a radius in the range from approximately 1.0 to 100 mm, preferably 10.0 mm to 80 mm, in this exemplary embodiment 18 mm. An increase in the flexibility of the sealing arrangement 3 is advantageously attainable thereby, for example so as to better be able to compensate for production-related tolerances, especially in the door gap or in the hinge region, respectively.

The profiled element 5 herein has a wall thickness of approximately 0.6 mm.

The profiled arrangement 1 according to the invention is furthermore configured such that the profiled element 5 is connected to the sealing arrangement 3 by way of a reinforcement element 6.

The profiled element 5 in this exemplary embodiment is connected to the hollow chamber 30 of the sealing arrangement 3 by way of a reinforcement element 6 which in this exemplary embodiment has a wall thickness of approximately 0.6 mm.

The movement arrangement 4 of the profiled arrangement 1 according to the invention in this exemplary embodiment is configured so as to protrude into the sealing arrangement 3 at an angle that is approximately acute in relation to the profiled element 5.

The movement arrangement 4 in this exemplary embodiment has two movement portions 40, 41 which are disposed so as to be mutually opposite and which are interconnected by way of a connection element 42. The first movement portion 40 in this exemplary embodiment is configured so as to be approximately parallel with the second movement portion 41 of the movement arrangement 4. The connection element 42 connects the first movement portion 40 to the second movement portion 41 of the movement arrangement 4 by way of a radius of approximately R 1. The profiled arrangement 1 according to the invention is furthermore configured such that the fastening arrangement 2 is disposed in a materially integral manner at an approximately right angle on the base 8.

The profiled element 5 of the profiled arrangement 1 according to the invention is furthermore configured such that said profiled element 5 on the free end 52 thereof has a cover element 7 which is disposed in a materially integral manner.

The profiled arrangement 1 according to the invention is furthermore configured such that the sealing arrangement 3 has a further seal element 9 which in this exemplary embodiment is disposed in a materially integral manner on the hollow chamber 31.

The base 8, the fastening arrangement 2, and the profiled element 5 of the profiled arrangement 1 according to the invention in this exemplary embodiment are likewise produced from a polymer material, specifically polyvinyl chloride (PVC), having a Shore D hardness according to DIN EN ISO 868 of approximately 78.

The invention claimed is:

1. A profiled arrangement for a refrigerator or freezer apparatus, comprising:

a base;

a fastening arrangement;

a sealing arrangement; and a profiled element;

wherein a first free end of the profiled element is disposed on the sealing arrangement;

wherein the profiled element, in relation to a hollow chamber of the sealing arrangement, is disposed on the hollow chamber so as to be approximately orthogonal thereto;

wherein a second free end of the profiled element is connected to the base by way of at least one movement arrangement;

wherein the movement arrangement protrudes into the sealing arrangement approximately at an acute angle in relation to the profiled element;

wherein the movement arrangement is disposed so as to be approximately orthogonal to the base of the profiled arrangement;

wherein the profiled element between the two free ends thereof has a width of approximately 5 to 50 mm and which has two movement portions that are disposed so as to be approximately opposite one another;

wherein the movement arrangement is produced from a soft elastic polymer material having a Shore A hardness according to DIN EN ISO 868 of approximately 50 to 100.

2. The profiled arrangement as claimed in claim 1, wherein the profiled element is disposed approximately at an acute or an obtuse angle on the sealing arrangement.

3. The profiled arrangement as claimed in claim 1, wherein the profiled element is disposed on the sealing arrangement so as to be approximately orthogonal.

4. The profiled arrangement as claimed in claim 1, wherein the profiled element is connected to the sealing arrangement by way of a reinforcement element.

5. The profiled arrangement as claimed in claim 1, wherein the profiled element is connected to a hollow chamber of the sealing arrangement by way of a reinforcement element.

6. The profiled arrangement as claimed in claim 1, wherein the profiled element has a cover element.

7. The profiled arrangement as claimed in claim 1, wherein the movement arrangement has two movement portions that are disposed so as to be approximately opposite one another and are interconnected by way of a connection element.

8. The profiled arrangement as claimed in claim 1, wherein the sealing arrangement or the profiled element is produced from a soft elastic polymer material having a Shore A hardness according to DIN EN ISO 868 of approximately 50 to 100.

9. A closure element for a refrigerator or freezer apparatus having the profiled arrangement as claimed in claim 1.

10. A refrigerator or freezer apparatus having the profiled arrangement as claimed in claim 1.

* * * * *